United States Patent [19]

Wilson et al.

[11] Patent Number: 4,750,645

[45] Date of Patent: Jun. 14, 1988

[54] BEVERAGE DISPENSING SYSTEM

[75] Inventors: Michael J. Wilson, Plainsboro; James E. Godfrey, East Brunswick, both of N.J.

[73] Assignee: General Foods Corporation, White Plains, N.Y.

[21] Appl. No.: 847,353

[22] Filed: Apr. 2, 1986

[51] Int. Cl.[4] ..... B67D 5/60

[52] U.S. Cl. ..... 222/145; 239/407; 137/605; 251/352; 222/129.2; 222/553

[58] Field of Search ..... 366/150, 163, 167; 137/605; 251/352; 285/305, 319, 376, 921; 222/105, 129.1–129.4, 133, 134, 145, 488, 504, 519–520, 544, 548, 553; 239/407, 417.5

[56] References Cited

U.S. PATENT DOCUMENTS

| | | | |
|---|---|---|---|
| 585,179 | 6/1897 | Bloemecke | 222/129.3 |
| 2,290,403 | 7/1942 | Wyss | 285/376 X |
| 3,250,551 | 5/1966 | Draudt | 285/319 X |
| 3,402,854 | 9/1968 | Marchetti | 222/129.2 X |
| 3,560,027 | 2/1971 | Graham | 285/305 X |
| 3,884,388 | 5/1975 | Holcomb | 222/132 |
| 4,173,296 | 11/1979 | Marshall | 222/129.1 |
| 4,408,631 | 10/1983 | Uhlig et al. | 251/352 X |
| 4,610,468 | 9/1986 | Wood | 285/81 |

FOREIGN PATENT DOCUMENTS

| | | | |
|---|---|---|---|
| 157366 | 7/1954 | Australia | 222/133 |
| 709079 | 8/1931 | France | 222/133 |
| 769011 | 2/1957 | United Kingdom | 222/129.2 |
| 2142315 | 1/1985 | United Kingdom | 222/133 |

OTHER PUBLICATIONS

*Liquid Juice Dispenser, Service Manual*; The Cornelius Company, Aneka, Minn., Oct. 14, 1983 (Manual Part No. 319181-000).

*Installation and Service Manual*, Golden Gem Mod 260 Juice Dispenser; Alco Dispensing Systems, Carol Stream, IL (46303 Rev. C).

*Primary Examiner*—Michael S. Huppert

*Attorney, Agent, or Firm*—Thomas R. Savoie; Daniel J. Donovan

[57] ABSTRACT

An improved beverage dispensing system utilizing a unique mixing valve design is disclosed. The mixing valve comprises an inner rotatable member an outer casing, and a flow restriction which produces a jet of spray, yielding a reconstituted beverage of uniform consistency.

11 Claims, 2 Drawing Sheets

BEVERAGE DISPENSING SYSTEM

TECHNICAL FIELD

The present invention relates to a beverage dispensing system with an improved level of convenience for operators. Moreover, the invention pertains to a novel valve design which operates in conjunction with the beverage dispensing system to provide a reconstituted beverage of a uniform consistency. The invention also serves to improve the sanitation of beverage dispensers.

BACKGROUND OF THE INVENTION

Various beverage dispensing systems are known in the art. Typical beverage dispensers are designed so as to combine a beverage concentrate with water at a predetermined ratio so as to produce a beverage which is then acceptable for consumption.

Two beverage dispensing systems which are presently marketed are illustrative of the beverage dispensing art. The Cornelius Company, Anoka, Minn., markets a juice dispenser Model No. 415050 which delivers juice concentrate from a concentrate tank to a "mounting block" where it mixes with water, then exiting through a spout as a ready-to-drink juice beverage. The Cornelius dispenser requires daily cleaning, which includes a water flush of the concentrate line, and a weekly sanitization of the system which is much more involved.

A second commercially available dispenser is the Golden Gem Model 260 Juice Dispenser marketed by Alco Dispensing Systems, Carol Stream, Ill. The Golden Gem dispenser delivers juice concentrate from a concentrate tank by way of a peristaltic pump to a mixing chamber where water and concentrate are combined. The mixing chamber is contained in a dispensing nozzle which delivers the ready-to-drink beverage. The Golden Gem dispenser also requires daily flushes and weekly sanitation operations.

In UK patent application GB No. 2,142,315A to Geiss, an apparatus for dispensing a mixture of fruit juice concentrate and water is disclosed. According to Geiss, a shut-off valve in the water conduit and a motor-driven peristaltic pump are jointly actuable, and when activated, cause fruit juice concentrate and water to be introduced to a drinking vessel. However, the system disclosed by Geiss fails to deliver a fruit juice beverage of uniform consistency.

It is desired to produce a beverage dispensing system which is more convenient for operator use.

It is a second object that a beverage dispensing system be sanitary.

Another object is that the beverage dispensing system yield a reconstituted beverage of uniform consistency.

These and other objects will become apparent in the discussions that follow.

SUMMARY OF THE INVENTION

It has now been found that the objects of the invention are achieved by a unique mixing valve design which may serve to (1) seal a concentrate container prior to concentrate use and (2) deliver a ready-to-drink beverage of uniform consistency. The mixing valve comprises an inlet for water, an inlet for concentrate, and an outlet for the ready-to-drink beverage formed by mixing of water and concentrate within the mixing valve. The mixing valve provides a means for forming a water jet which, in conjunction with the overall valve design, results in a reconstituted beverage of uniform consistency. According to a preferred embodiment of the invention, said mixing valve has substantially two positions, a "closed" position wherein the concentrate inlet is sealed, and an "open" position wherein the concentrate inlet communicates with the interior of the mixing valve.

DETAILED DESCRIPTION OF THE INVENTION

Figure 1:
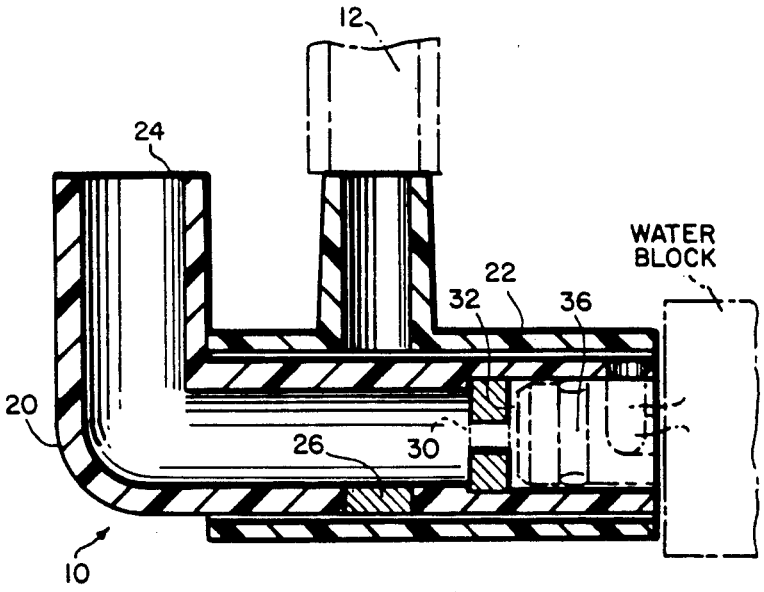
FIG. 1 shows a cross-sectional side view of a mixing valve in the "closed" position which is engaged but not locked to a water source.

The preparation of ready-to-drink beverages from beverage concentrates is commonplace in food service operations. Typically, a beverage concentrate is mixed with water at a ratio of about 3:1 to 6:1 by volume water to concentrate in order to produce a beverage for consumption. Typical beverage concentrates include juice concentrates such as orange, lemon-lime, cherry, etc. and other beverages such as tea and coffee. It is possible to prepare hot ready-to-drink beverages by reconstituting beverage concentrates such as coffee with hot water. The concentrates are typically contained in a vessel, as for example a bag-in-box or high density polyethylene container.

According to the invention, a beverage concentrate is fed to an inlet in a unique mixing valve. Typically, the beverage concentrate is fed to the valve body through a flexible tubing, as for example a polyethylene, silicone or surgical-type rubber tubing, which may optionally be transparent. Beverage concentrate is typically pumped to the mixing valve. A particularly well-suited means for pumping the beverage concentrate is a peristaltic pump which has flexible tubing fed through the pump's operational chamber. In this way, rotation of the pump's geared member results in pulses of concentrate passing through the tubing and into the valve inlet. In a preferred embodiment of the invention, the beverage concentrate is fed from a vessel located above the mixing valve and the valve inlet is located substantially at the top of the valve.

The valve of the invention has a second inlet for receipt of an aqueous flow, typically a water flow. The spatial relationship of the aqueous flow to the aforementioned beverage concentrate flow through their respective mixing valve inlets is essentially perpendicular. Thus, in a preferred embodiment of the invention water flow through the water inlet is essentially horizontal whereas concentrate flow is essentially vertically downward. As will be seen, the directional relationship of these flows is critical to achieving a reconstituted beverage of uniform consistency.

A second critical feature of the novel mixing valve consists of a flow restriction in the aqueous flow path. Said flow restriction, in conjunction with a back pressure in the aqueous flow line, results in an aqueous jet being formed within the mixing valve. The flow restriction is located at a point prior to the point at which the aqueous stream will meet and combine with the beverage concentrate. Said flow restriction is sized such that the internal cross-sectional area for aqueous flow within the valve is reduced by at least about 50%, typically about 65% and preferably about 75%. The axial length of the flow restriction is not critical. The flow restriction may be instantaneous or there may be a tapering of the cross-sectional area before and/or after the flow restriction. Typically, a back pressure of at least 5 psig is maintained on the aqueous fluid, and preferably a back pressure between about 5 psig and 40 psig.

Beyond the flow restriction moving axially away from the aqueous inlet, the mixing valve of the invention contains an intersection of the two flow paths, that is the flow path for the beverage concentrate and the flow path for the aqueous stream. Thus, a tee is formed at the point of combination. That is to say that a perpendicular intersection is formed by the flow line for beverage concentrate which preferably is vertical, and the flow line for the aqueous flow within the valve which preferably is horizontal. The relationship between the cross-sectional areas of these two flow lines is not critical, though extreme differences are not preferred.

After the two flows are combined, the combination flows axially in the direction of flow of the aqueous stream, within the mixing valve. Thus, in typical operation, a jet of aqueous fluid intersects a beverage concentrate and the two fluids are thereby combined, moving axially in the direction of the aqueous fluid flow, preferably horizontally. Though it has been found that a degree of mixing occurs when the concentrate and aqueous fluid are combined, it has been found to be critical in achieving a reconstituted beverage of uniform consistency that a change in flow direction be effected thereafter. That is to say, a change in flow direction, typically in the form of an elbow, has been found to be critical to achieving a homogeneously reconstituted beverage according to the invention. Typically, the change in flow direction is about 90 degrees and preferably said change is from horizontal to vertical flow. The distance from the point of flow intersection to the point of flow direction change is not altogether critical. However, such distance should not be so great that the turbulence created by the flow restriction has dissipated prior to the change in flow direction.

In a particularly preferred embodiment of the invention, the mixing valve has essentially two positions, a "closed" position wherein the concentrate inlet is sealed and an "open" position wherein said inlet is unobstructed. In this preferred embodiment, said mixing valve is preferably integrally attached to a beverage concentrate source, as for example, an aseptically packaged beverage concentrate-containing vessel. In such an embodiment, the mixing valve of the present invention serves as the seal for the beverage concentrate vessel when in the closed position. When in the open position, the beverage concentrate vessel communicates with the mixing valve through the concentrate inlet. The mixing valve may preferably be discarded with the concentrate vessel when its contents are depleted. Such an operation is extremely sanitary and convenient for operators.

The invention is now further described with reference to the attached figures. This description is intended merely to be illustrative and the scope of the invention is not to be limited beyond what is claimed below.

In FIG. 1, mixing valve 10 is integrally attached to a beverage concentrate vessel by way of tube 12. Mixing valve 10 is comprised of rotatable member 20 which is rotatable within outer casing 22. Rotation of said rotatable member such that discharge outlet 24 faces downward results in opening 26 aligning with tube 12. Orifice 30 is a flow restriction in flow path 32. Mixing valve 10 is attached to male fitting 36 which extends from a water source and is locked thereon when rotatable member 20 is rotated as described above, thereby locking pin 38 in channel 18.

Figure 2:
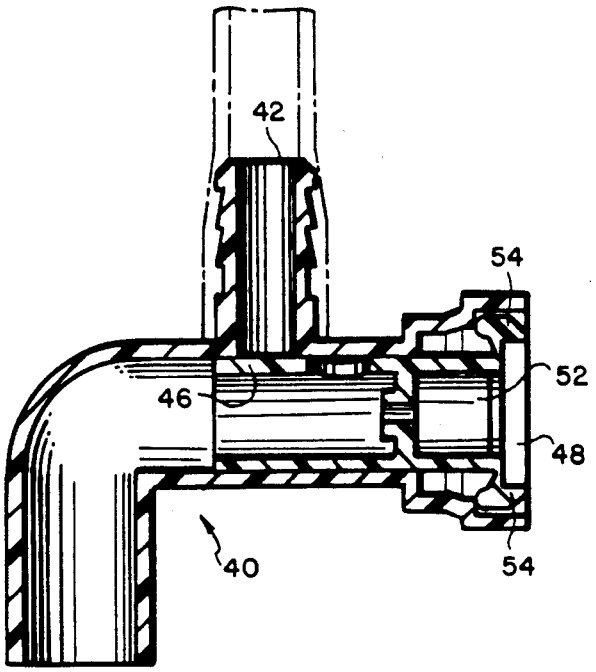
FIG. 2 shows a cross-sectional side view of a mixing valve in the "closed" position.

FIG. 2 shows an alternative mixing valve 40 which is attached to a concentrate vessel by tube 42 which is blocked by sliding member 46. Valve plug 48 protects male receiver 52.

Figure 3:
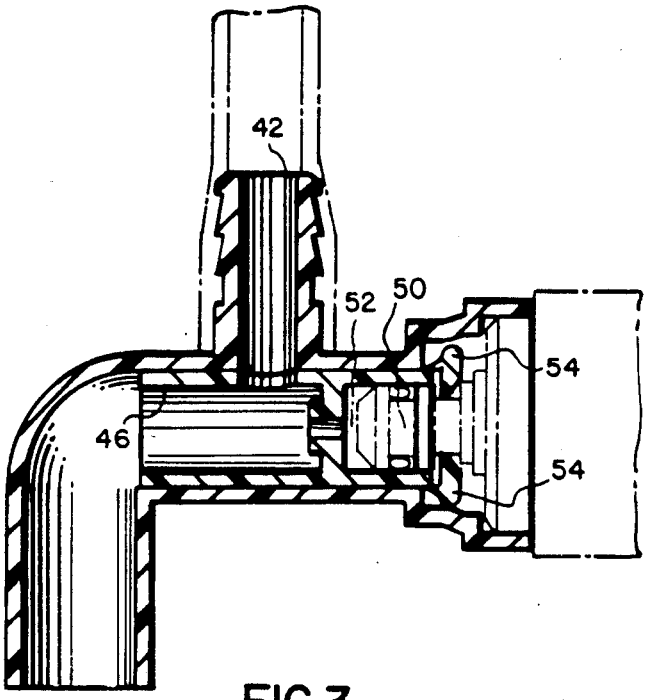
FIG. 3 shows a cross-sectional side view of a mixing valve in the "open" position which is engaged and locked to a water source.

In FIG. 3, sliding member 46 has been moved forward by inserting male fitting 50 into male receiver 52 until locking members 54 rotate into a locked position.

Figure 4:
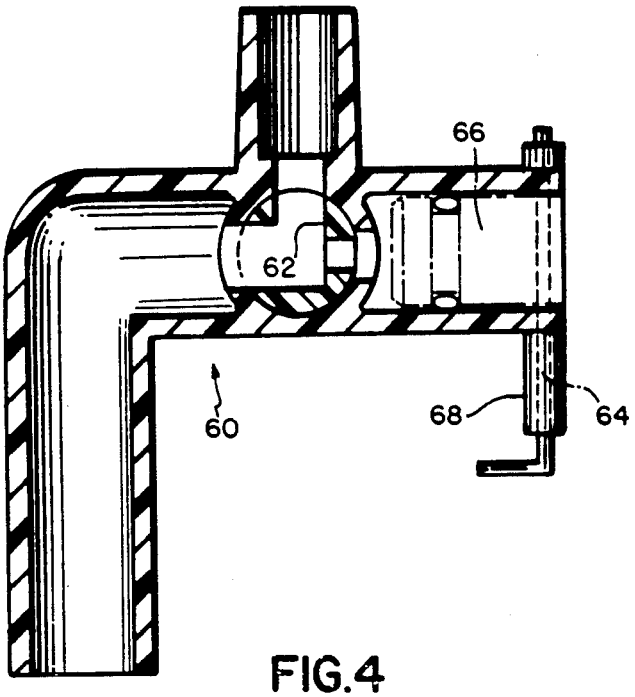
FIG. 4 shows a cross-sectional side view of a mixing valve in the "open" position which is engaged and locked to a water source.

In FIG. 4, turnkey 62 is rotatable within mixing valve 60. Sliding door 64 moves within a guiding channel 68 and secures said mixing nozzle to male fitting 66.

We claim:

1. A mixing valve to produce beverages of uniform consistency by combining water and a beverage concentrate, said valve comprising:

(a) a first inlet for water, wherein water flow through the inlet is essentially horizontal;

(b) a second inlet for beverage concentrate, wherein concentrate flow through the inlet is essentially vertical;

(c) an outlet for the beverage;

(d) an outer casing;

(e) an inner movable member defining a horizontal flowpath and having an opening which is selectively alignable with said second inlet, said inner member being movable between a closed position wherein the concentrate inlet is sealed and an open position wherein the concentrate inlet communicates with the interior of the mixing valve, said inner member being movable within the outer casing;

(f) a flow restriction in the path of the water flow, said flow restriction reducing the cross-sectional area of the water flow path by at least about 50% and said flow restriction being located prior to the water flow intersecting the concentrate flow;

(g) said outer casing and said inner member defining means to permit the flow of water to intersect the flow of concentrate and to pass the resultant combined flow in the direction of the water flow; and (h) elbow means to effect a change in the direction of the combined flow, said elbow means feeding the outlet for the beverage.

2. The valve of claim 1 wherein said flow restriction is at least 65% of the cross-sectional area.

3. The valve of claim 1 wherein said flow restriction is at least 75% of the cross-sectional area.

4. The valve of claim 1 which further comprises a means for attaching said first inlet to a fitting.

5. The valve of claim 4 wherein said means of attachment is an interlocking pin and channel.

6. The valve of claim 4 wherein said means of attachment comprises rotating locking members which rotate into a locked position by introducing a male fitting into said first inlet of said valve body.

7. The valve of claim 4 wherein said means of attachment comprises a sliding door which moves within a guiding channel.

8. The valve of claim 1 wherein said valve is integrally attached to a beverage concentrate vessel at said second inlet.

9. The valve of claim 8 wherein said integral attachment is by tubing.

10. The valve of claim 1 wherein said valve is moved between said two positions by rotating the monable inner member.

11. The valve of claim 1 wherein the elbow means changes to the flow direction from horizontal to vertical.

* * * * *